US006299192B1

(12) United States Patent
Bryce

(10) Patent No.: US 6,299,192 B1
(45) Date of Patent: Oct. 9, 2001

(54) SPORTING EQUIPMENT BINDING APPARATUS

(75) Inventor: Jonathan Bryce, Cottage Point (AU)

(73) Assignee: Griplock PTY LTD, Wahroonga (AU)

( * ) Notice: Subject to any disclaimer, the term of this patent is extended or adjusted under 35 U.S.C. 154(b) by 0 days.

(21) Appl. No.: 09/395,083

(22) Filed: Sep. 13, 1999

(30) Foreign Application Priority Data

Sep. 14, 1998 (AU) ..... PP5901

(51) Int. Cl.[7] ..... A63C 9/00

(52) U.S. Cl. ..... 280/613; 280/612; 280/14.22

(58) Field of Search ..... 280/613, 612, 280/14.22, 14.21, 634, 618, 607; 36/117.3, 131, 132, 115; 74/594.4, 594.6; 403/327, 403, 384, 397, DIG. 7

(56) References Cited

U.S. PATENT DOCUMENTS

| | | | | |
|---|---|---|---|---|
| 2,276,826 | * | 3/1942 | Crowther | 280/612 |
| 3,537,719 | * | 11/1970 | Gottfried | 280/612 |
| 3,667,771 | * | 6/1972 | Larson | 280/612 |
| 3,727,932 | * | 4/1973 | Druss et al. | 280/613 |
| 3,775,866 | * | 12/1973 | Marker | 280/613 |
| 3,899,190 | * | 8/1975 | Schweizer et al. | 280/613 |
| 3,902,729 | | 9/1975 | Druss . | |
| 4,185,851 | | 1/1980 | Salomon . | |
| 4,278,269 | | 7/1981 | Beyl . | |
| 4,298,210 | | 11/1981 | Lotteau et al. . | |
| 4,361,344 | | 11/1982 | Hull . | |
| 4,403,785 | | 9/1983 | Hottel . | |
| 4,653,203 | | 3/1987 | DeMatthesis . | |
| 4,728,115 | | 3/1988 | Pozzobon et al. . | |
| 4,739,564 | | 4/1988 | Eser . | |
| 4,792,156 | | 12/1988 | Hue . | |
| 4,803,894 | | 2/1989 | Howell . | |
| 4,815,333 | | 3/1989 | Sampson . | |
| 4,928,982 | | 5/1990 | Logan . | |

(List continued on next page.)

FOREIGN PATENT DOCUMENTS

| | | |
|---|---|---|
| 89878/82 | 5/1984 | (AU) . |
| 33890/84 | 10/1984 | (AU) . |
| 2 623 464 | 5/1989 | (FR) . |
| WO 87/07119 | 12/1987 | (WO) . |
| WO 87/07120 | 12/1987 | (WO) . |
| WO 97/48301 | 12/1997 | (WO) . |

*Primary Examiner*—J. J. Swann
*Assistant Examiner*—James S. McClellan
(74) *Attorney, Agent, or Firm*—Akerman Senterfitt

(57) ABSTRACT

Binding apparatus for use with an item of sports equipment, including a first part adapted for attachment to an article of footwear and a second part adapted for attachment to the item of sports equipment. The second part includes a protuberance. The first part is a housing adapted to be mounted in the sole of the article of footwear, and includes a recess adapted to receive the protuberance. The first and second parts have complementary securing parts for releasably securing the protuberance in the recess when the protuberance reaches a predetermined engagement therein for sideways pivoting movement of the article of footwear relative to the item of sports equipment. The recess has a substantially cylindrical face generally perpendicular to the sole of the article of footwear, and a lower opening defined by an inner lip for receiving the protuberance therethrough. The securing parts include an outwardly biassed ring mounted on the protuberance, the ring being compressible from a normally expanded position in which it does not pass through the lower opening to a compressed position in which it does pass through the opening. The ring may be forced through the lower opening into the recess by compressing the ring, whereupon the ring engages with the lip to retain the protuberance in the recess. The protuberance may be released from the recess upon application of a breakaway force so that the ring is forced back through the lower opening by compressing the ring.

3 Claims, 5 Drawing Sheets

U.S. PATENT DOCUMENTS

| | | | | |
|---|---|---|---|---|
| 4,936,164 | | 6/1990 | Forkë . | |
| 4,942,778 | | 7/1990 | Bryne . | |
| 5,044,654 | | 9/1991 | Meyer . | |
| 5,054,807 | | 10/1991 | Fauvet . | |
| 5,213,009 | | 5/1993 | Bryne . | |
| 5,236,216 | | 8/1993 | Ratzek . | |
| 5,251,508 | | 10/1993 | Robbins . | |
| 5,269,200 | | 12/1993 | Hawkins . | |
| 5,325,738 | | 7/1994 | Bryne . | |
| 5,435,080 | | 7/1995 | Meiselman . | |
| 5,473,963 | | 12/1995 | Aeschbach . | |
| 5,520,405 | | 5/1996 | Bourke . | |
| 5,553,516 | | 9/1996 | Weiss . | |
| 5,641,172 | | 6/1997 | Hoffman et al. . | |
| 5,692,323 | | 12/1997 | Goldberg . | |
| 5,852,955 | | 12/1998 | Crisick et al. . | |
| 5,913,530 | * | 6/1999 | Berger et al. | 280/607 |
| 5,954,357 | * | 9/1999 | Golling | 280/612 |
| 6,022,040 | * | 2/2000 | Buzbee | 250/213 |

* cited by examiner

SPORTING EQUIPMENT BINDING APPARATUS

TECHNICAL FIELD OF THE INVENTION

This invention relates to binding apparatus and has particular application to binding apparatus for use with items of sports equipment such as skateboards and surfboards where advantage can be gained from being releasably secured to the item of sports equipment and for illustrative purposes reference will be made to such applications. However it is to be understood that the invention could have application with other items of sports equipment such as bicycles.

BACKGROUND ART

The desirability of a user being releasably attached to an item of sports equipment has been recognised for some time as evidenced by Australian Patent Specification No. 33890/84 by Hamilton. The Hamilton specification describes apparatus for use with a surfboard, including complementary layers of interlocking hook and loop fasteners of the type known as "VELCRO" attached to the board rider's boots and the surfboard respectively. The Hamilton invention appears to have a number of drawbacks, for example, it does not seem to easily allow correct alignment of the board rider's boots with the board at a predetermined desirable position and also does not provide the rider with the opportunity to pivot his feet while riding the board. Co-pending International patent application No. PCT/AU97/00375 by the present applicant describes binding apparatus which inter alia aims to overcome these drawbacks and describes binding apparatus which includes two inter-engaging parts, one having a protuberance with a plurality of tongue members and the other having a recess with a lip and the tongue members being arranged to releasably engage the lip within the recess. The present invention is aimed at providing binding apparatus of simpler form for use with an item of sports equipment such as a skateboard or surfboard whereby the item of sports equipment may be selectively secured to and released from the persons footwear as desired. Like the aforementioned International application the invention also aims to provide binding apparatus which allows the rider to relatively easily secure his footwear to the item of sports equipment in a predetermined position and which allows the user to release himself from the sports equipment upon application of a predetermined breakaway force.

DISCLOSURE OF THE INVENTION

With the foregoing and other objects in view, the invention in one aspect resides broadly in binding apparatus for use with an item of sports equipment such as a skate board, the binding apparatus including a first part adapted for attachment to an article of footwear and a second part adapted for attachment to the item of sports equipment, said second part including a protuberance and said first part being a housing mounted in or adapted to be mounted in the sole of the article of footwear, said housing including a recess adapted to receive therein said protuberance, said first and second parts also having complementary securing means for releasably securing said protuberance in said recess upon said protuberance reaching therein a predetermined engagement for sideways pivoting movement of said article of footwear relative to said item of sports equipment, said recess having a substantially cylindrical face generally perpendicular to the sole of the article of footwear, and a lower opening defined by an inner lip adapted to receive therethrough said protuberance, said securing means including an outwardly biassed ring mounted on said protuberance, said ring being compressible from a normally expanded position in which it does not pass through said lower opening and a compressed position in which it does pass, the parts being so made and arranged that said ring may be forced through said lower opening in one direction into said recess by compressing said ring upon application of a predetermined application force whereupon said ring may engage with said lip to retain said protuberance in said recess and said protuberance may be released from said recess upon application of a predetermined breakaway force so that said ring is forced through said lower opening in the other direction by compressing said ring.

In another aspect, the invention resides broadly in binding apparatus for use with an item of sports equipment such as a skate board, the binding apparatus including a first part adapted for attachment to an article of footwear and a second part adapted for attachment to the item of sports equipment, said second part including a protuberance and said first part being a housing mounted in or adapted to be mounted in the sole of the article of footwear, said housing including a recess adapted to receive therein said protuberance, said first and second parts also having complementary securing means for releasably securing said protuberance in said recess and being adapted to releasably secure said protuberance in said recess upon said protuberance reaching therein a predetermined engagement for sideways pivoting movement of said article of footwear relative to said item of sports equipment, said recess having a substantially cylindrical face generally perpendicular to the sole of the article of footwear, and a lower opening defining an entry to said recess for receiving therethrough said protuberance, said securing means including an inwardly biassed ring mounted in a groove in said cylindrical wall portion and an outwardly extending flange on said protuberance, said ring being expandable from a normally compressed position in which the outwardly extending flange does not pass through said ring and an expanded position in which it does pass, the parts being so made and arranged that said flange may be forced into said recess through said lower opening in one direction and past said inwardly biassed ring by expanding said ring whereupon said ring may engage with said flange to retain said protuberance in said recess, and said protuberance may be released from said recess upon application of a predetermined breakaway force so that said flange is forced past said ring in the other direction by expanding said ring.

In yet another aspect, the invention resides broadly in binding apparatus for use with an item of sports equipment such as a skate board, the binding apparatus including a first part adapted for attachment to an article of footwear and a second part adapted for attachment to the item of sports equipment, said second part including a protuberance and said first part being a housing mounted in or adapted to be mounted in the sole of the article of footwear, said housing including a recess adapted to receive therein said protuberance, said first and second parts also having complementary securing means for releasably securing said protuberance in said recess upon said protuberance reaching therein a predetermined engagement for sideways pivoting movement of said article of footwear relative to said item of sports equipment, said recess having a substantially cylindrical face generally perpendicular to the sole of the article of footwear and having a lower opening defined by an inner lip for receiving therethrough said protuberance, said substantially cylindrical wall portion being comprised of a plurality of arcuate wall portions depending from an upper part of said housing, the lower ends of said arcuate wall portions being adapted for movement radially outwardly to increase the size of said lower opening and being biassed inwardly, and an outwardly extending flange on said protuberance, the parts being so made and arranged that said flange may be forced into said recess past said inner lip by forcing said arcuate wall portions radially outwardly whereupon they engage with said flange to retain said protuberance in said recess and said protuberance may be released from said recess upon application of a predetermined break away force by forcing said arcuate wall portions radially outwardly.

In still yet another aspect, the invention resides broadly in binding apparatus for use with an item of sports equipment such as a skate board, the binding apparatus including a first part adapted for attachment to an article of footwear and a second part adapted for attachment to the item of sports equipment, said second part including a protuberance and said first part being a housing mounted in or adapted to be mounted in the sole of the article of footwear, said housing including a recess adapted to receive therein said protuberance, the first and second parts also having complementary securing means for releasably securing said protuberance in said recess upon said protuberance reaching therein a predetermined engagement for sideways pivoting movement of said article of footwear relative to said item of sports equipment, said recess having a substantially cylindrical face generally perpendicular to the sole of the article of footwear and having a lower opening defining an entry to said recess for receiving therethrough said protuberance, said securing means including a portion or part constructed of a magnetically attractant material, preferably a rare earth magnetic material mounted in said recess, and said protuberance including a portion or a part which is magnetically attractive to said magnetically attractant material, the parts being so made and arranged that the magnetic forces between said magnetically attractant material and said magnetically attractive portions or part retain said protuberance in said recess and allow pivoting of said protuberance in said recess, and said protuberance may be released from said recess upon application of a predetermined breakaway force.

Preferably, the protuberance is allowed to pivot relative to the recess through at least ninety degrees so that a rider can manipulate the item of sports equipment through a large part of the riders possible ankle movement. This is particularly important for skateboards.

It is to be understood that the terms "adapted for attachment to an article of footwear" and "adapted for attachment to the item of sports equipment" include articles of footwear and items of equipment in which the first part and second part are integrally provided respectively.

BRIEF DESCRIPTION OF THE DRAWINGS

In order that the invention may be more clearly understood and put into practical effect, reference will now be made to the accompanying drawings which illustrate preferred embodiments of the invention and wherein.

DETAILED DESCRIPTION OF THE DRAWINGS

Figure 1:
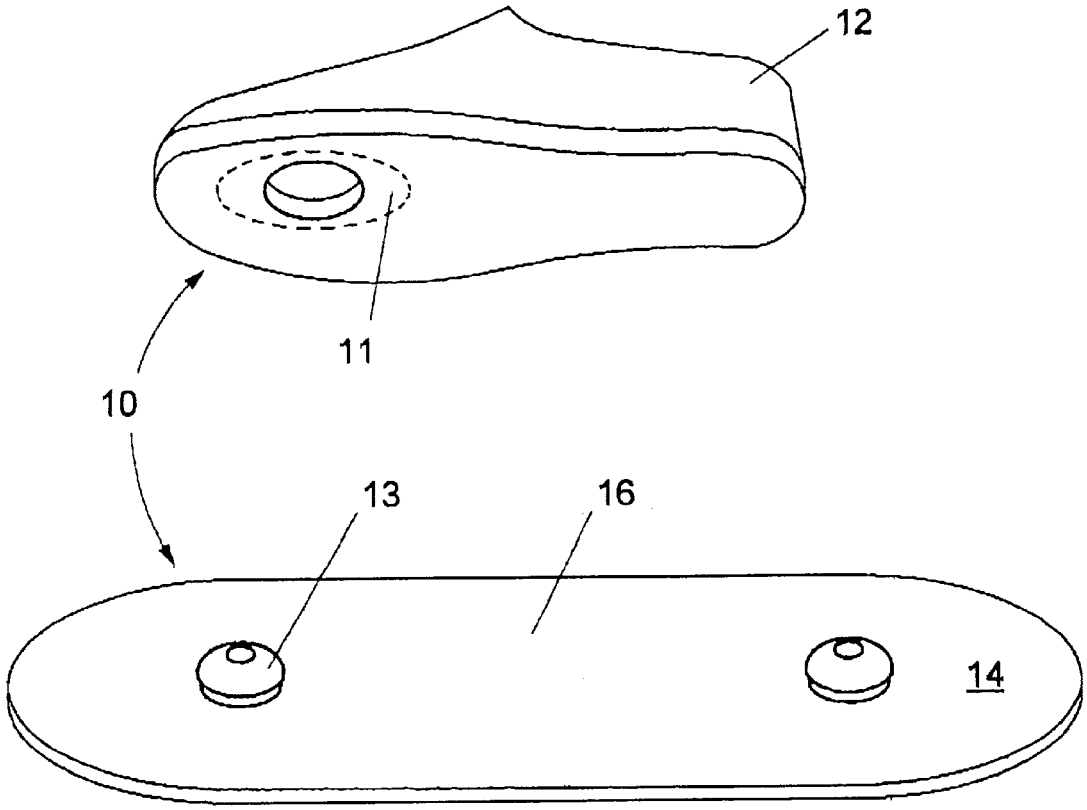
FIG. 1 is a pictorial schematic representation of various forms of binding apparatus according to the invention in use with a skateboard, with a first part being mounted in the sole of a shoe and a second part being screwed to the skateboard.

The binding apparatus 10 illustrated in FIG. 1 includes a housing 11 constituting a first part of the apparatus secured within the outer sole of a shoe 12 immediately beneath the ball of a wearers foot and a dome shaped knob 13 constituting a second part of the apparatus secured to the upper face of the platform 14 of a skateboard 16, the knob being adapted to cooperate with the housing so as to connect the skateboard to the shoe. The terms upper and lower as used herein are to be understood as being referenced to the normal standing position of a person wearing the shoe 12.

Figure 2A:
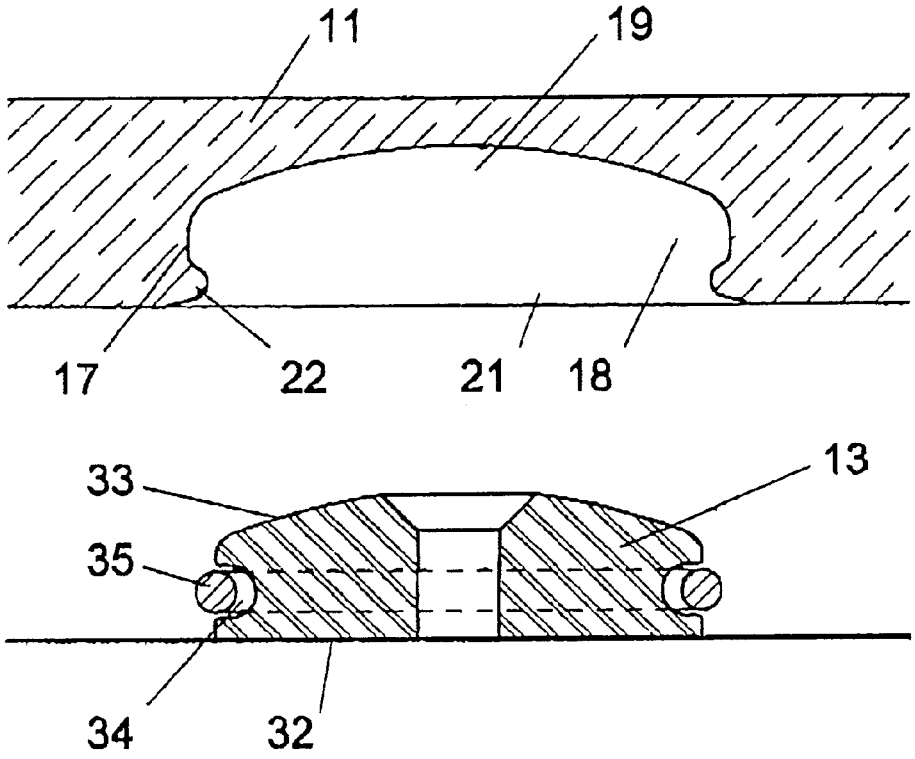
FIG. 2*a* is a cross-sectional side elevation of one form of apparatus adapted to function in the manner shown in FIG. 1 with the first part in line for assembly with the second part.
Figure 2B:
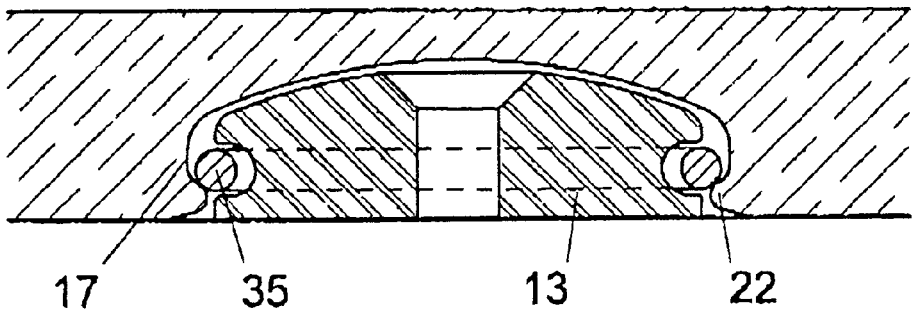
FIG. 2*b* is a cross-sectional side elevation of the modified apparatus of FIG. 2*a* with the first part engaged with the second part.

As more clearly shown in FIGS. 2*a* and 2*b*, a recess 18 is formed in the housing 11 and has a substantially cylindrical inner wall portion 17 generally perpendicular to the sole of the shoe. The recess has an upper portion 19 and a downward facing opening 21 defined by an inner lip or flange 22 formed within the wall portion which defines an entry to the recess for receiving therethrough the knob 13 illustrated in FIG. 2*a*.

Although not shown in the embodiments illustrated, the housing 11 is moulded from a plastics material and includes flanges 23 extending sidewardly from the portion in which the recess is formed for providing an anchor about which the outer sole 24*b* of the shoe 12 is moulded to secure the housing therein similar to that illustrated in co-pending International patent application No. PCT/AU97/00375.

The knob 13 is substantially cylindrical in form having a planar lower face 32 which rests on the upper surface of the platform 14 and a domed upper face 33. The knob is secured to the platform of the skateboard by a screw 42 located on the vertical axis and extending fully therethrough and is accessible from the domed upper face. Additionally, the head of the screw is located in a round countersunk hole in the domed upper face. It will be seen that the diameter of the knob is slightly less than the diameter of the lower opening 21 so that it can fit easily therethrough for engagement in the recess 18.

A groove 34 is provided in the cylindrical face of the knob 13 and a ring 35 constructed of spring steel wire is seated in the groove and normally biassed to a position half in the groove and half out of the groove. The ring is toroidal in form but incomplete, that is to say, the free ends of the wire are spaced apart by a small distance to allow the ring to be compressed against its bias to locate completely within the groove. It will be appreciated that in the normally biassed position the outside diameter of the ring is greater than the diameter of the opening 21 and can engage with the inside face of the lit 22 to retain the protuberance in the recess 18 as shown in FIG. 2*b*.

In use, either one or two of the knobs 13 are secured to the platform of a skateboard in a predetermined desired position by screws 42 respectively. A rider wearing either one or a pair of shoes 12 can then fit one foot to the front knob and push off with the other foot whereupon he may wish to secure the second foot to the skateboard by the second knob. In such an arrangement, the skateboard rider would be able to perform various tricks, for example jumps, in which the skateboard would travel through the air with him and more or less effectively becoming a part of his body.

The rider would be able to release his foot or feet from the skateboard by exerting an upwardly directed breakaway force with one foot whilst holding the skateboard down with the other foot so that the lip 22 would cause the ring 35 to compress slightly towards the axis of the knob and out of securing engagement with the lip 22. It will be appreciated that some pivoting or rocking movement coincidentally with application of the breakaway force may assist in releasing the housing 11 from the knob 13. Such rocking movement may include rocking forwards and backwards and/or side to side.

Figure 3A:
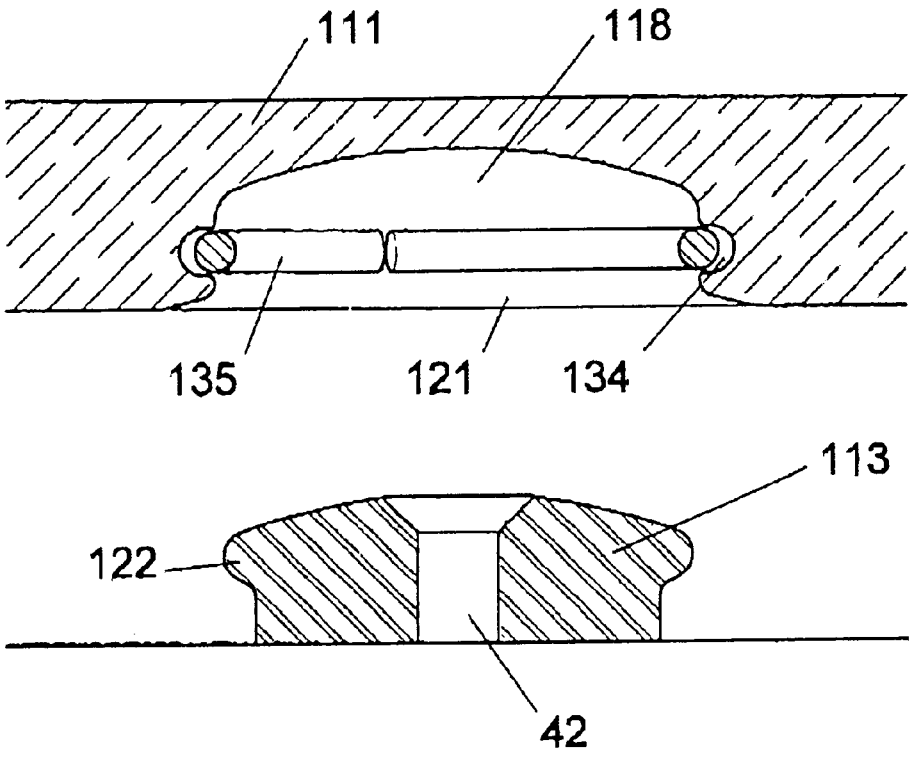
FIG. 3*a* is a cross-sectional side elevation of another form of apparatus adapted to function in the manner shown in FIG. 1 with the first part in line for assembly with the second part.
Figure 3B:
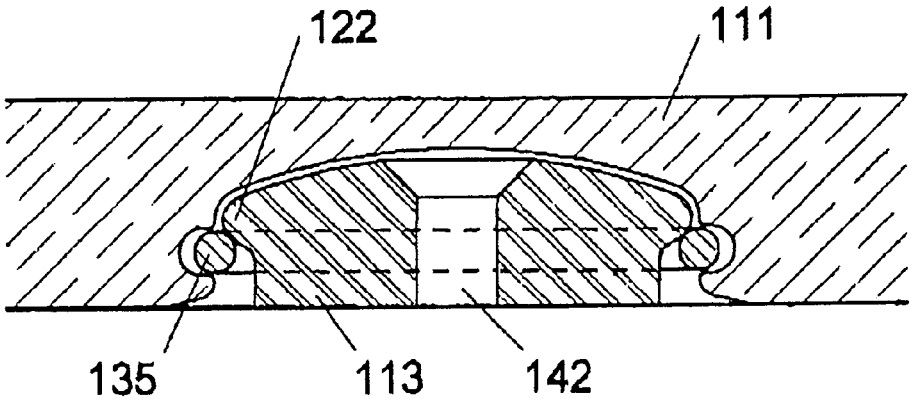
FIG. 3*b* is a cross-sectional side elevation of the apparatus of FIG. 3*a* with the first part engaged with the second part.

In the following description of alternative forms of binding apparatus, corresponding numbers have been used to reference components corresponding to components of the previous apparatus, but prefaced by a "1", a "2" or a "3" respectively. The binding apparatus illustrated in FIGS. 3*a* and 3*b* is substantially an inverse arrangement of that illustrated in FIGS. 2*a* and 2*b* in that a toroidal shaped ring 135 is seated in a groove 134 provided in the inner cylindrical face 117 of the recess 118 of the housing 111. A flange 122 is provided at the other end portion of the protuberance 113 and is adapted to engage with the ring to retain the knob in the recess as shown in FIG. 3*b*.

Figure 4A:
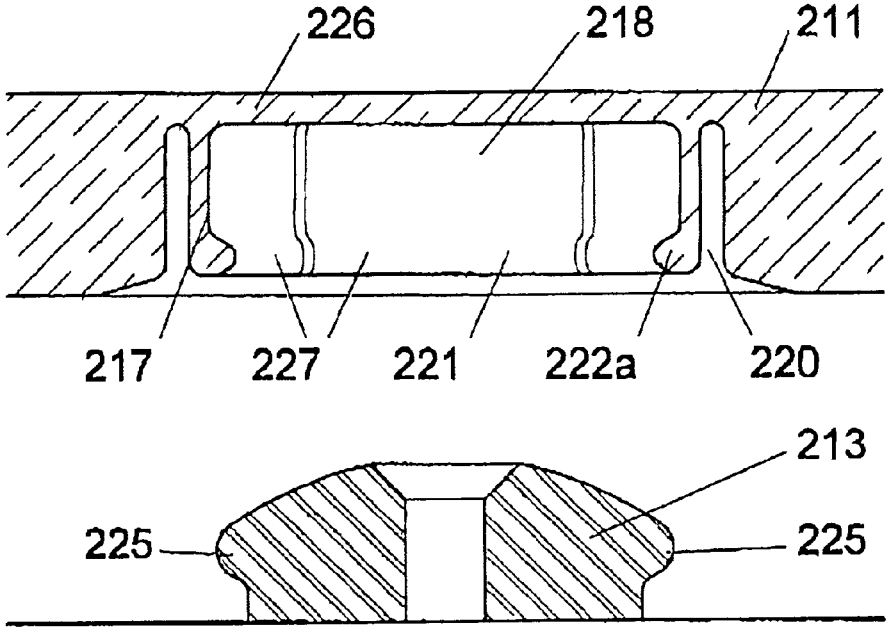
FIG. 4*a* is a cross-sectional side elevation of yet another form of apparatus adapted to function in the manner shown in FIG. 1 with the first part in line for assembly with the second part.
Figure 4B:
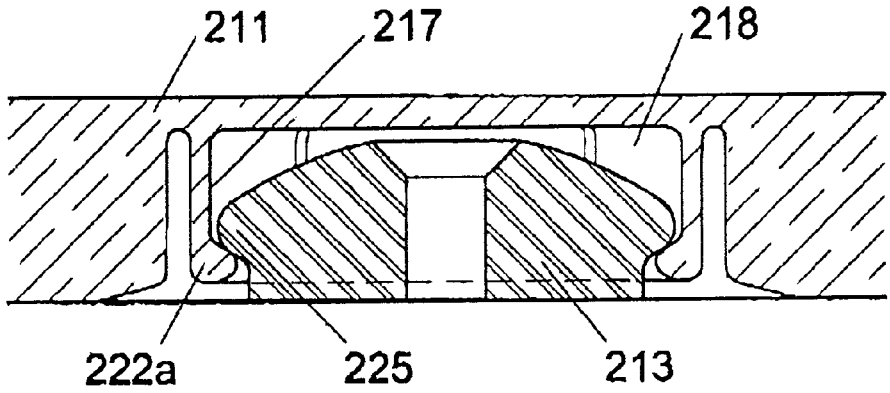
FIG. 4*b* is a cross-sectional side elevation of the apparatus of FIG. 4*a* with the first part engaged with the second part.

The knob 213 of the embodiment illustrated in FIGS. 4*a* and 4*b* is very similar to that illustrated in FIGS. 3*a* and 3*b* and has a flange 222 at its upper end portion. However, the housing 211 is significantly different and has a skirt depending from an upper wall portion 226 within an outer recess 220, the skirt defining a recess 218 adapted to receive the knob 213. The skirt is made up of a plurality of arcuate portions 227 having complimentary lip portions 222*a* extending radially inwardly at their lower ends to define an opening 221 for receiving the flange 225 therethrough. In use, the arcuate wall portions 227 bend radially outwardly about their upper ends within the recess 220 as the domed face of the knob engages therewith. Upon the flanges 225 passing through the opening 221 the arcuate wall portions spring back to their normally biassed position as illustrated in FIG. 4*b* to retain the knob 213 in the recess 218.

Figure 5:
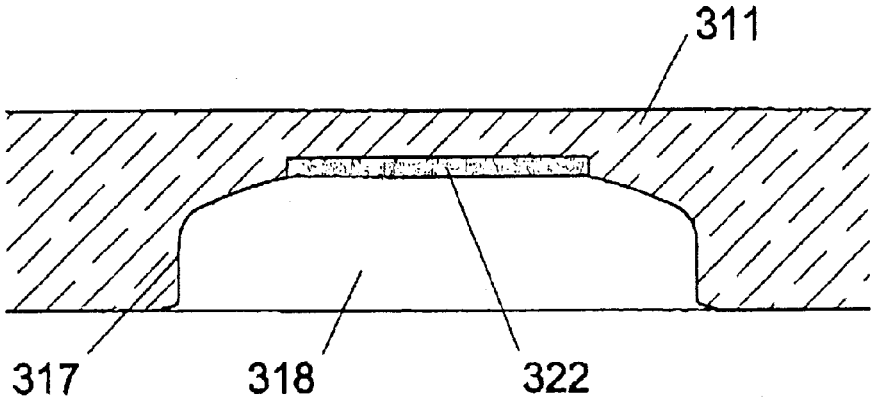
FIG. 5 is a cross-sectional side elevation of yet another form of apparatus adapted to function in the manner shown in FIG. 1 with the first part in line for assembly with the second part.
Figure 5:
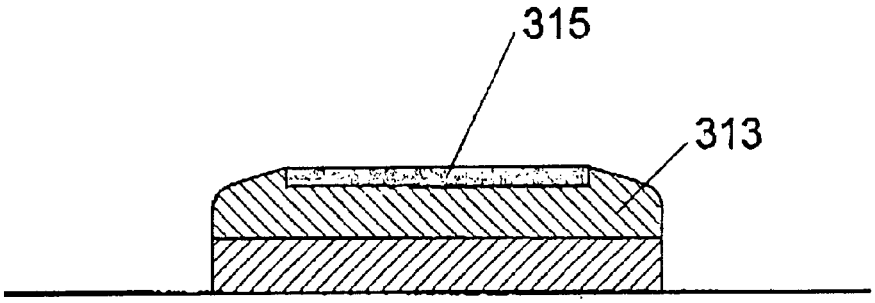

In the binding apparatus illustrated in FIG. 5, the housing 311 has a recess 318 provided therein and a rare earth magnet 322 is secured in the upper portion thereof in this case by an adhesive. The knob 313 is substantially cylindrical in form and has a metal disc 315 secured to its upper face and adapted to cooperate with the rare earth magnet to retain the knob in the recess.

It will of course be realised that while the foregoing invention has been described generally in relation to items of sports equipment, it has other applications where a person may wish to have his feet releasably secured to a platform or other foundation such as in construction or factory applications. Accordingly, the description has been given by way of illustrative example of the invention only and all other modifications and variations thereto as would be apparent to persons skilled in the art are deemed to fall within the broad scope and ambit of this invention as is defined in the appended claims.

What is claimed is:

1. A binding apparatus for use with an item of sports equipment, including a first part adapted for attachment to an article of footwear and a second part adapted for attachment to the item of sports equipment, said second part including a protuberance and said first part being a housing adapted to be mounted in the sole of the article of footwear, said housing including a recess adapted to receive therein said protuberance, said first and second parts also having complementary securing means for releasably securing said protuberance in said recess upon said protuberance reaching therein a predetermined engagement for sideways pivoting movement of said article of footwear relative to said item of sports equipment, said recess having a substantially cylindrical face generally perpendicular to the sole of the article of footwear, and a lower opening defined by an inner lip adapted to receive therethrough said protuberance, said securing means including an outwardly biassed ring mounted on said protuberance, said ring being compressible from a normally expanded position in which it does not pass through said lower opening and a compressed position in which it does pass, the parts being so made and arranged that said ring may be forced through said lower opening in one direction into said recess by compressing said ring upon application of a predetermined application force whereupon said ring may engage with said lip to retain said protuberance in said recess and said protuberance may be released from said recess upon application of a predetermined breakaway force so that said ring is forced through said lower opening in the other direction by compressing said ring.

2. A binding apparatus for use with an item of sports equipment, including a first part adapted for attachment to an article of footwear and a second part adapted for attachment to the item of sports equipment, said second part including a protuberance and said first part being a housing adapted to be mounted in the sole of the article of footwear, said housing including a recess adapted to receive therein said protuberance, said first and second parts also having complementary securing means for releasably securing said protuberance in said recess and being adapted to releasably secure said protuberance in said recess upon said protuberance reaching therein a predetermined engagement for sideways pivoting movement of said article of footwear relative to said item of sports equipment, said recess having a substantially cylindrical face generally perpendicular to the sole of the article of footwear, and a lower opening defining an entry to said recess for receiving therethrough said protuberance, said securing means including an inwardly biassed ring mounted in a groove in said cylindrical wall portion and an outwardly extending flange on said protuberance, said ring being expandable from a normally compressed position in which the outwardly extending flange does not pass through said ring and an expanded position in which it does pass, the parts being so made and arranged that said flange may be forced into said recess through said lower opening in one direction and past said inwardly biassed ring by expanding said ring whereupon said ring may engage with said flange to retain said protuberance in said recess and said protuberance may be released from said recess upon application of a predetermined breakaway force so that said flange is forced past said ring in the other direction by expanding said ring.

3. A binding apparatus for use with an item of sports equipment, including a first part adapted for attachment to an article of footwear and a second part adapted for attachment to the item of sports equipment, said second part including a protuberance and said first part being a housing adapted to be mounted in the sole of the article of footwear, said housing including a recess adapted to receive therein said protuberance, said first and second parts also having complementary securing means for releasably securing said protuberance in said recess and being adapted to releasably secure said protuberance in said recess upon said protuberance reaching therein a predetermined engagement for sideways pivoting movement of said article of footwear relative to said item of sports equipment, said recess having a substantially cylindrical face generally perpendicular to the sole of the article of footwear, and having a lower opening defined by an inner lip for receiving therethrough said protuberance, said substantially cylindrical wall portion being comprised of a plurality of arcuate wall portions depending from an upper part of said housing, the lower ends of said arcuate wall portions being adapted for movement radially outwardly to increase the size of said lower opening and being biassed inwardly, and an outwardly extending flange on said protuberance, the parts being so made and arranged that said flange may be forced into said recess past said inner lip by forcing said arcuate wall portions radially outwardly whereupon they engage with said flange to retain said protuberance in said recess and said protuberance may be released from said recess upon application of a predetermined breakaway force by forcing said arcuate wall portions radially outwardly.

* * * * *